US007284529B2

(12) United States Patent
Nagahama et al.

(10) Patent No.: US 7,284,529 B2
(45) Date of Patent: Oct. 23, 2007

(54) ENGINE

(75) Inventors: Masahiro Nagahama, Sakai (JP); Kozo Yoshida, Sakai (JP); Yoshihiko Kawamoto, Sakai (JP); Hiroshi Sasaki, Sakai (JP); Takashi Onishi, Sakai (JP); Mitsugu Okuda, Sakai (JP); Nobuyuki Kobayashi, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 11/350,512

(22) Filed: Feb. 9, 2006

(65) Prior Publication Data

US 2007/0181091 A1 Aug. 9, 2007

(51) Int. Cl.
*F01P 1/04* (2006.01)

(52) U.S. Cl. ..... 123/196 R; 123/195 R

(58) Field of Classification Search ..... 123/196 R, 123/195 R

See application file for complete search history.

(56) References Cited

U.S. PATENT DOCUMENTS 4,869,211 A * 9/1989 Heberle et al. ..... 123/41.35
6,578,541 B2 * 6/2003 Stromsky et al. ..... 123/195 R
6,715,460 B2 * 4/2004 Ashida et al. ..... 123/196 R
2002/0020385 A1 * 2/2002 Stromsky et al. ..... 123/196 R

FOREIGN PATENT DOCUMENTS

JP 4-314908 A 11/1992

* cited by examiner

*Primary Examiner*—Stephen K. Cronin
(74) *Attorney, Agent, or Firm*—Akin Gump Strass Hauer & Feld LLP

(57) ABSTRACT

An engine comprises a crank case (1) provided with a lower opening portion (2), which is covered with an oil pan (3) from below, and with a pair of left and right oil passages which extends in a front and rear direction along left and right lateral walls (5) and (6). In this engine, the crank case (1) has the left and right lateral walls (5) and (6) provided with left and right ribs (12) and (13) extending in the front and rear direction. These left and right ribs (12) and (13) are raised inwards from the left and right lateral walls (5) and (6) of the crank case (1). In order to provide left and right oil passages (7) and (8) in these left and right ribs (12) and (13), these ribs (12) and (13) are positioned at the lower opening portion (2) of the crank case (1).

13 Claims, 9 Drawing Sheets

ENGINE

BACKGROUND OF THE INVENTION

1. Technical Field

The present invention relates to an engine and more particularly it concerns an engine able to enhance the strength of a crank case.

2. Earlier Technology

There is a conventional example of this engine which comprises a crank case provided with a lower opening portion, which is covered with an oil pan from below, and with a pair of left and right oil passages which extends in a front and rear direction along left and right lateral walls of the crank case, as well as the present invention The engine of this kind has an advantage to facilitate its production since it dispenses with external pipings for the left and right oil passages.

However, the conventional engine provides left and right ribs on the left and right lateral walls of the crank case, which extend in the left and right direction. These left and right ribs are raised inwardly from the left and right lateral walls of the crank case. In order to provide left and right oil passages in these left and right ribs, these left and right ribs are positioned higher than the lower opening portion of the crank case. This causes problems.

The above-mentioned prior art has the following problems.

<Problem> The lower opening portion of the crank case has a peripheral wall of a low strength.

Since the left and right ribs are positioned higher than the lower opening portion of the crank case, the lower portion of the crank case is low in the strength of its peripheral wall. This invites an insufficient strength of the whole crank case and also a difficulty of attempting to increase output.

<Problem> It is impossible to enlarge a rotation radius of a crank pin.

Due to the fact that the left and right ribs are positioned higher than the lower opening portion of the crank case, if the rotation radius of the crank pin is enlarged, it entails a likelihood that a larger-diameter portion of a connecting rod interferes with them. For this reason, it is necessary to decrease the rotation radius of the crank pin with the result of being unable to lengthen the stroke of a piston so as to increase the output of the engine.

<Problem> There is a case where lubricity becomes insufficient.

In the event that the left and right ribs are made small so as to avoid the interference with the larger-diameter portion of the connecting rod, it is impossible to sufficiently increase the sectional area of each of the left and right oil passages, In this case, the lubricity becomes so insufficient that the engine cannot cope with the sliding resistance of every sliding portion which increases along with the increase of output.

The present invention has an object to provide an engine capable of solving the above-mentioned problems and more particularly, to provide an engine able to increase the strength of the crank case.

The characteristic matter of the invention as set forth in claim 1 is as follows.

As exemplified in FIGS. 1, 2 and 3(A), an engine comprises a crank case 1 provided with a lower opening portion 2, which is covered with an oil pan 3 from below, and, on the assumption that a direction where a crank shaft 4 spans is a front and rear direction and that a widthwise direction of the crank case 1 is a left and right direction, it is provided with a pair of left and right oil passages 7, 8 which extends in the front and rear direction along left and right lateral walls 5 and 6. In this engine, as exemplified in FIGS. 2 and 3(A), the left and right lateral walls 5 and 6 of the crank case 1 are provided with left and right ribs 12 and 13, respectively which extend in the front and rear direction. These left and right ribs 12 and 13 are raised from the left and right lateral walls 5 and 6 of the crank case 1. In order to form left and right oil passages 7 and 8 in these left and right ribs 12 and 13, these left and right ribs 12 and 13 are positioned at the lower opening portion 2 of the crank case 1.

(Invention of Claim 1)

Effect> The lower opening portion of the crank case has a peripheral wall of a high strength.

As illustrated in FIGS. 2 and 3(A), since the left and right ribs 12 and 13 are positioned at the lower opening portion 2 of the crank case 1, the lower opening portion 2 of the crank case 1 is high in the strength of the peripheral wall. This results in the possibility of enhancing the entire strength of the crank case 1 in an attempt to increase the output.

<Effect> It is possible to enlarge the rotation radius of the crank pin.

As exemplified in FIG. 2, owing to the fact that the left and right ribs 12 and 13 are positioned at the lower opening portion 2 of the crank case 1, even if the rotation radius of the crank pin 17 is enlarged, there is no likelihood that the larger-diameter portion 33 of the connecting rod interferes with them. Thus it is possible to enlarge the rotation radius of the crank pin 17 and lengthen the stroke of the piston with the result of being able to attempt to increase the output.

<Effect> It is possible to enhance the lubricity.

As shown in FIG. 2, the left and right ribs 12 and 13 can be largely raised without fearing the interference with the larger-diameter portion 33 of the connecting rod. Therefore, the left and right oil passages 7 and 8 provided internally of these ribs 7 and 8 can increase their sectional areas to sufficient ones and can enhance the lubricity, which in turn results in the possibility of coping with the sliding resistance of every sliding portion which increases along with the enhancement of the output.

(Invention of Claim 2)

It offers the following effect in addition to those of the invention as set forth in claim 1.

<Effect> It is possible to increase the rotation radius of the crank pin.

As exemplified in FIGS. 2, 4 and 5, the rotation radius from a center axis 4*a* of the crank shaft 4 to the outermost portion of the crank pin 17 is made larger than an inner diameter of each of intermediate bearing holes 14*a*, 15*a* and of an end bearing hole 16*a*. The intermediate bearing holes 14*a* and 15*a* have peripheral edge portions provided with recesses 14*d* and 15*d* and also the end bearing hole 16*a* is provided with a recess 16*d*, thereby enabling the outermost portion of the crank pin 17 to pass through every recess 14*d*, 15*d* and 16*d* upon accommodating the crank shaft 4 in the crank case 1. This makes it possible to increase the rotation radius of the crank pin 17 and elongate the stroke of the piston in an attempt to increase the output.

(Invention of Claim 3)

It offers the following effect in addition to that of the invention as set forth in claim 2.

<Effect> It is possible to inhibit the disadvantage of splashing up the oil by the crank shaft.

As illustrated in FIGS. 2 and 5, the recesses 14*d* and 15*d* of the intermediate bearing holes 14*a* and 15*a* are arranged at an upper side portion of the intermediate bearing holes

14*a* and 15*a*. This prevents the recesses 14*d* and 15*d* from being clogged by waved oil within the oil pan 3 to result in always communicating the respective partitioned chambers of the crank case 1 with each other through the recesses 14*d* and 15*d*. Further, it levels the pressure variation of every partitioned chamber, caused through pumping of the piston. This prohibits the disadvantage of splashing up the oil 9, which has floated up due to the pressure variation in every partitioned chamber, by the crank shaft 4, which in turn inhibits the loss of horse power, the oil deterioration and the oil consumption.

(Invention of Claim 4)

It offers the following effect in addition to those of the invention as set forth in claim 1.

<Effect> The lower opening portion of the crank case has a peripheral wall of high strength.

As shown in FIG. 3(B), a reference hole 18 communicated with either of the left and right oil passages 7 and 8 is sealed by a steel ball 20 struck thereinto after having worked the cylinder block 19. Consequently, when compared with the case where this is sealed by a cup-like plug, the lower opening portion 2 of the crank case 1 has a peripheral wall of higher strength.

(Invention of Claim 5)

It offers the following effect in addition to those of the invention as set forth in claim 1.

<Effect> It is possible to increase the amount of oil within the oil pan.

As exemplified in FIG. 1, the oil pan 3 is extended up to below a timing gear case 21 to result in the possibility of increasing the amount of oil 9 able to be stored in the oil pan 3. Thus it is possible to cope with the sliding resistance of every sliding portion which increases along with the enhancement of the output.

<Effect> It is possible to increase the strength of the oil pan.

As exemplified in FIG. 1, the oil pan 3 is extended up to below the timing gear case 21. The thus extended portion 3*a* of the oil pan 3 has an upper end attached to a lower end portion 21*a* of the timing gear case 21 with the result of being able to increase the strength of the oil pan 3.

(Invention of Claim 6)

It offers the following effect in addition to that of claim 5.

<Effect> It is possible to effectively utilize the timing gear case as a portion for attaching an auxiliary machine.

As exemplified in FIG. 6(A), when seen in a direction parallel to a center axis 4*a* of the crank shaft 4, the timing gear case 21 has a lower portion projected more laterally than the lateral wall 6 of the crank case 1. This more laterally projected portion 21*b* of the timing gear case 21 is provided with a seat 22 for attaching the auxiliary machine 23. Accordingly, it is possible to effectively utilize the timing gear case 21 as the portion for attaching the auxiliary machine 23.

(Invention of Claim 7)

It offers the following effect in addition to that of the invention as set forth in claim 6.

<Effect> It is possible to effectively utilize a lateral side of the crank case as a space for accommodating the auxiliary machine.

As exemplified in FIG. 7, the seat 22 for attaching the auxiliary machine 23 is provided at a rear portion of the laterally projected portion 21*b* and the auxiliary machine 23 attached to the seat 22 for attaching the same is made to position along the lateral wall 6 of the crank case 1. Therefore, it is possible to effectively utilize the lateral side of the crank case 1 as the space for accommodating the auxiliary machine 23.

(Invention of Claim 8)

It offers the following effect in addition to that of the invention as set forth in claim 6.

<Effect> It is possible to seal an overlapping portion and to attach a first idling gear at the same time.

As exemplified in FIGS. 7 and 9, there is arranged a first idling gear 26 between a crank gear 24 and an input gear 25 for the auxiliary machine 23. The timing gear case 21 has a rear wall 17 composed of an overlapping portion 27*a*, which overlaps a front wall 28 of the crank case 1, and a portion 27*b* which laterally projects from the front wall 28 of the crank case 1. The overlapping portion 27*a* is fixed in pressure-contact with the front wall 28 of the crank case 1 through a fastening force of a bolt 26*a* for attaching the first idling gear 26. Consequently, it is possible to seal the overlapping portion 27*a* with respect to the front wall 28 of the crank case and to attach the idling gear 26 simultaneously.

(Invention of Claim 9)

It offers the following effects in addition to that of the invention as set forth in claim 8.

<Effect> It is possible to enhance the strength of the timing gear case.

As shown in FIGS. 6(B) and 6(C), a closure 29 for an opening portion 21*c* is formed with a rib 29*a*. This can enhance the strength of the closure 29 and in turn the strength of the timing gear case 21. Thus even if the driving reaction force of the auxiliary machine 23 is strong, the timing gear case 21 can receive it.

<Effect> It is possible to effectively utilize the rib for a wall of the oil passage.

As exemplified in FIG. 6(B), the rib 29*a* is internally provided with an oil passage 29*b*. Therefore, the rib 29*a* can be effectively utilized as the wall of the oil passage.

(Invention of Claim 10)

It offers the following effect in addition to that of the invention as set forth in claim 9.

<Effect> It is possible to more enhance the strength of the timing gear case.

As exemplified in FIGS. 6(B) and 6(C), the rib 29*a* of the closure 29 is formed so that it is bent along a surface of the closure 29. This results in the possibility of more enhancing the strength of the timing gear case 21. Thus the timing gear case 21 can receive the stronger driving reaction force of the auxiliary machine 23.

(Invention of Claim 11)

It offers the following effect in addition to that of the invention as set forth in claim 8.

<Effect> It is possible to attach a second idling gear and to fix the seat for attaching the auxiliary machine at the same time.

As exemplified in FIG. 7, there is provided a second idling gear 0 between the first idling gear 26 and the input gear 25 for the auxiliary machine 23. The seat 22 for attaching the auxiliary machine 23 is made to position along the laterally projected portion 27*b* of the rear wall 27 of the timing gear case 21 and is fixed thereto by a tightening force of a bolt 30*a* for attaching the second idling gear 30. This makes it possible to simultaneously attach the second idling gear 30 and to fix the seat 22 for attaching the auxiliary machine 23 with the result of enhancing the workability when assembling the engine.

(Invention of Claim 12)

It offers the following effect in addition to that of the invention as set forth in claim 11.

<Effect> Lubricity is high at a portion where gears mesh with each other.

As shown in FIG. 9, a gear accommodating chamber 31 which accommodate the input gear 25 for the auxiliary machine 23 has a bottom 31*a* where oil stays. The oil is lifted up along an inner peripheral surface of the gear accommodating chamber 31 through the rotation of the input gear 25 for the auxiliary machine 23 and is supplied from above to a portion 32 where the second idling gear 30 meshes with the input gear 25 for the auxiliary machine 23. Therefore, the portion 32 has so high a lubricity that even if the portion 32 receives the strong driving reaction force of the auxiliary machine, it is prevented from being worn off.

(Invention of Claim 13)

It offers the following effect in addition to those of the invention as set forth in claim 1.

<Effect> It is possible to make the engine compact.

As illustrated in FIG. 7, the auxiliary machine 23 is a hydraulic pump which gives output against the external load applied to the engine. Consequently, when compared with the case where output is given by a wrapping transmission device or the like, the engine can be made compact.

BRIEF DESCRIPTION OF THE DRAWINGS

FIG. 3 is an explanatory view of a cylinder block of the engine shown in FIG. 1.

FIG. 6(A) is a front view, and FIG. 6(B) is a front view of a closure and FIG. 6(C) is a rear view of the closure;

FIG. 8 is an explanatory view of the gear case of the engine shown in FIG. 1.

DETAILED DESCRIPTION OF THE PREFERRED EMBODIMENT

An explanation is given for an embodiment of the present invention.

FIGS. 1 to 9 explains an engine according to the embodiment of the present invention. In this embodiment, the explanation is given by using a vertical three-cylinder and water-cooled diesel engine.

This engine is outlined as follows.

Figure 1:
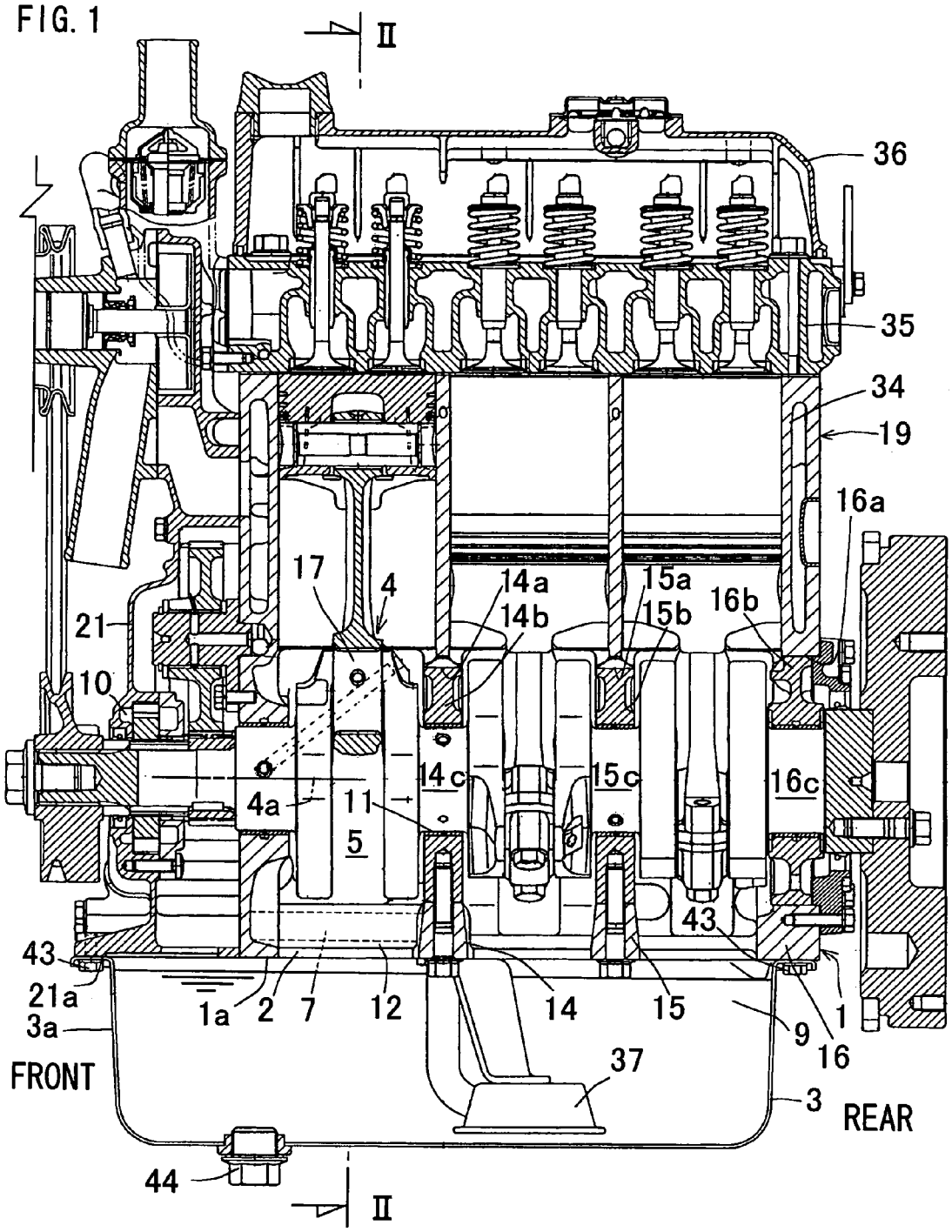
FIG. 1 is a vertical and sectional side view of an engine according to an embodiment of the present invention.

As shown in FIG. 1, it comprises a cylinder block 19 integrally formed with a crank case 1 and a cylinder 34. A cylinder head 35 is assembled to an upper portion of the cylinder 34. A head cover 36 is assembled to an upper portion of the cylinder head 35. The crank case 1 has a lower portion to which an oil pan 3 is assembled. A crank shaft 4 is accommodated within the crank case 1. On the assumption that a direction where the crank shaft 4 spans is taken as a front and rear direction, a timing gear case 21 is assembled to a front portion of the cylinder block 1.

A lubricating device has the following structure.

Figure 2:
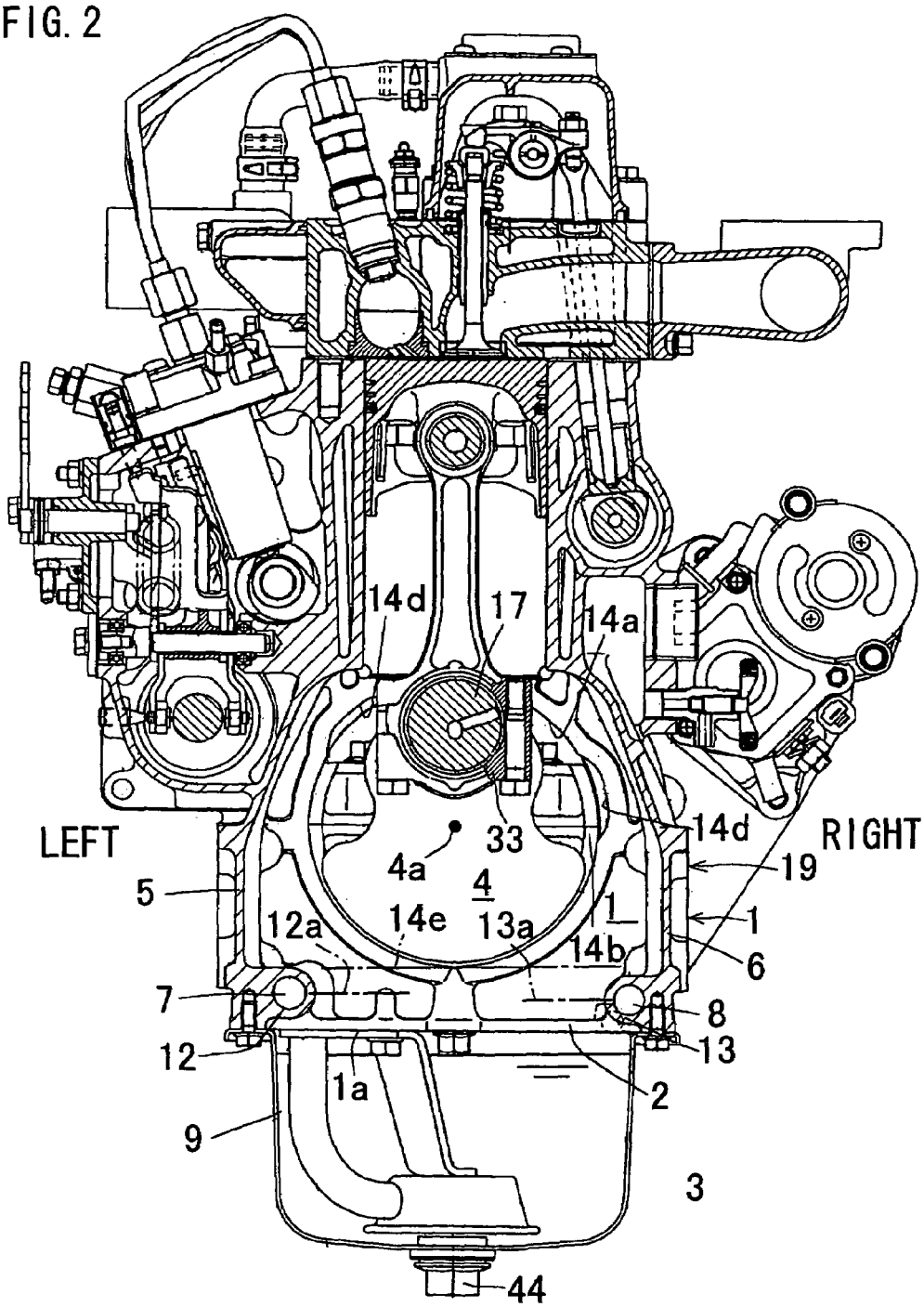
FIG. 2 is a sectional view taken along a line II-II in FIG. 1.
Figure 3A:
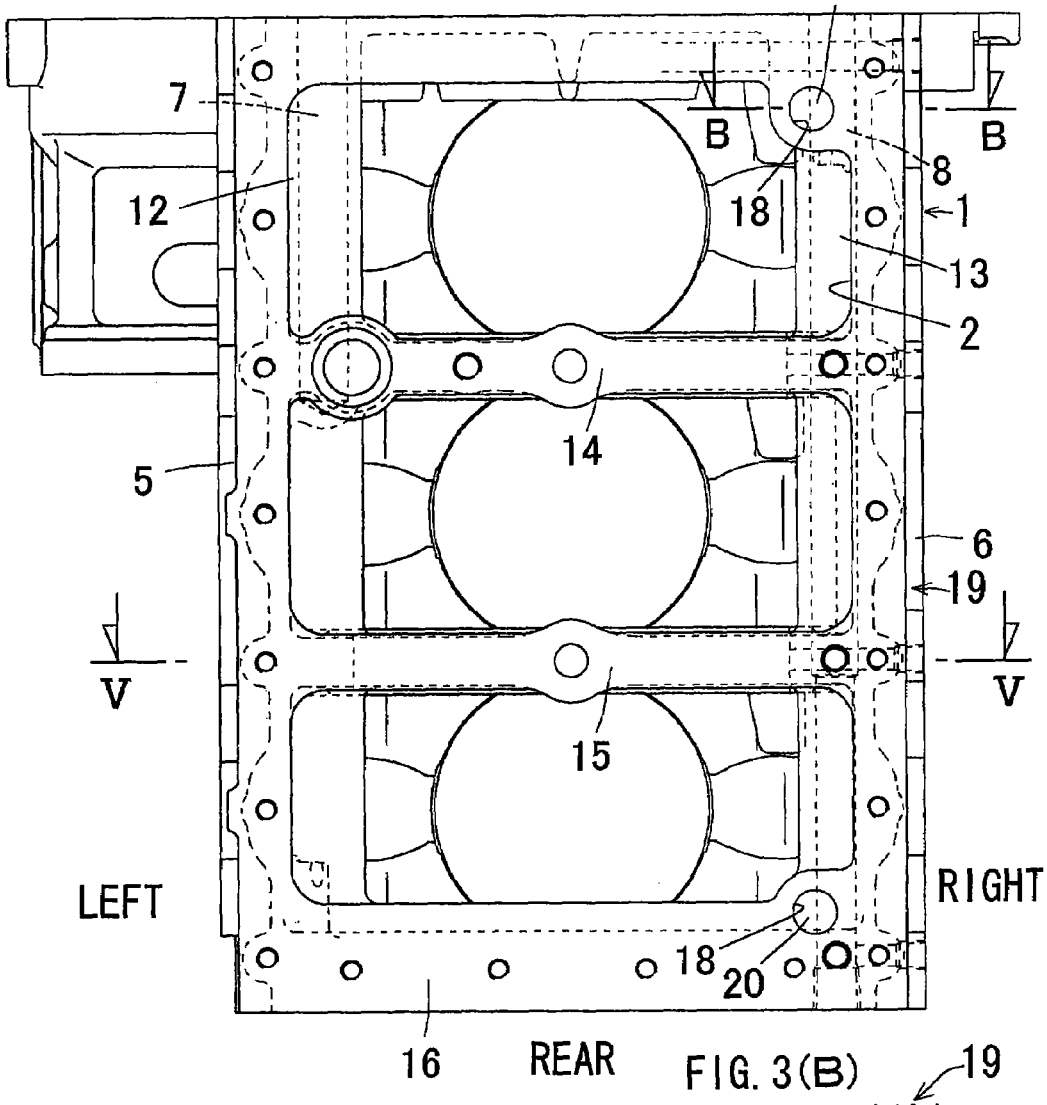
FIG. 3(A) is a bottom view and FIG. 3(B) is a sectional view taken along a line B-B in FIG. 3(A)
Figure 3B:
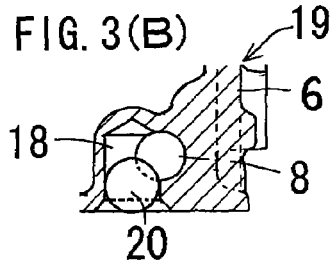

As illustrated in FIG. 1, the crank case 1 is provided with a lower opening portion 2, which is covered from below with the oil pan 3. On the assumption that the direction where the crank shaft 4 spans is taken as the front and rear direction and that a widthwise direction of the crank case 1 is deemed as a left and right direction as shown in FIGS. 2 and 3(A), a pair of left and right oil passages 7 and 8 which extends in the front and rear direction is provided along left and right lateral walls 5 and 6 of the crank case 1. As shown in FIG. 1, oil 9 within the oil pan 3 is sucked into an oil pump 10 through the left oil passage 7. The oil is sent under pressure from the oil pump 10 to sliding portions 11 through the right oil passage 8. The sliding portions 11 are bearing portions of the crank shaft 4 and the like.

The oil flows from the oil pan to the sliding portions as follows.

Figure 8A:
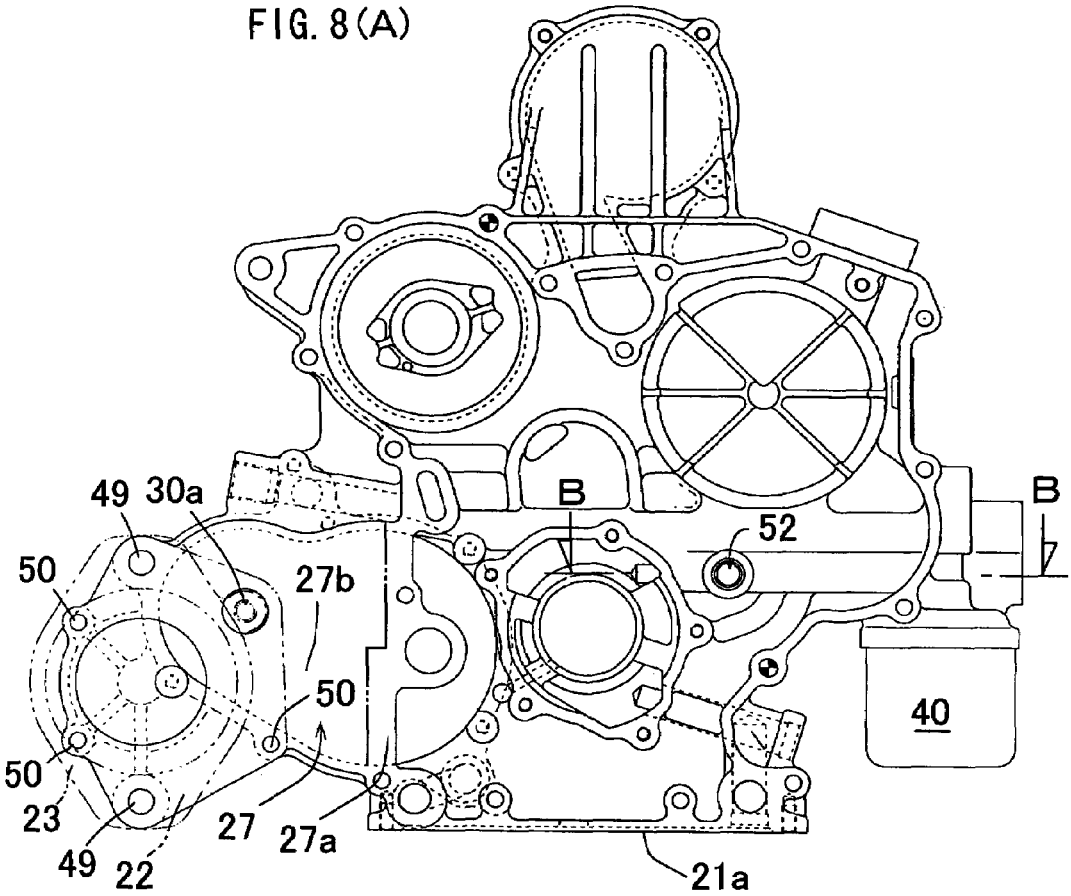
FIG. 8(A) is a rear view and FIG. 8(B) is a sectional view taken along a line B-B in FIG. 8(A)
Figure 8B:
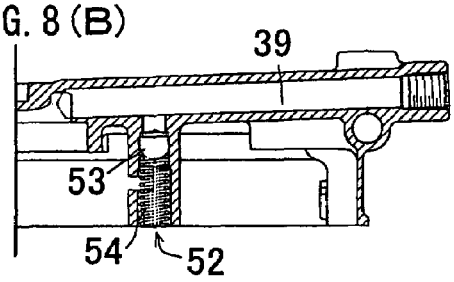

The oil within the oil pan 3 flows from an oil strainer 37 shown in FIG. 1 through the left oil passage 7, which is arranged along the left lateral wall 5 of the crank case 1, and then passes through a pump suck-in passage 38, an oil pump 10, a pump discharge passage 39, an oil filter 40, an oil-purification passage 41, an oil passage 29*b* within a rib 29 and an oil-purification outlet 42 provided in the timing gear case 21 in the mentioned order. Then it is supplied to every sliding portion through the right oil passage 8 which is positioned along the right lateral wall 6 of the crank case 1 as shown in FIGS. 2 and 3(A). As shown in FIG. 8(B), the pump discharge passage 39 has a rear portion provided with a relief valve 52. The crank case 1 has a front wall 28 which receives a base portion of a valve spring 54 for biasing a valve body 53 of the relief valve 52. Therefore, when the timing gear case 21 is removed from the front wall 28 of the crank case 1, the valve body 53 and the valve spring 54 of the relief valve 52 can be attached and detached from the timing gear case 21 without attaching and detaching a plug or the like.

The lubricating device is devised as follows.

As shown in FIGS. 2 and 3(A), the crank case 1 has the left and right lateral walls 5 and 6 provided with left and right ribs extending in the front and rear direction. These left and right ribs are raised inwardly from the left and right lateral walls 5 and 6 of the crank case 1. In order to provide the left and right oil passages 7 and 8 in these left and right ribs 12 and 13, these left and right ribs 12 and 13 are positioned at the lower opening portion 2 of the crank case 1. As illustrated in FIG. 2, the left and right ribs 12 and 13 have their heights set so that the respective vertical height positions 12*a* and 13*a* of their mid portions are arranged between a lower end 1*a* of the crank case 1 and a height position 14*e* of the lowermost end portion of an intermediate bearing hole 14*a*. Each of the left and right ribs 12 has an upper surface set to a position identical to or lower than the height position 14*e* of the lowermost portion of the intermediate bearing hole 14*a* between a first cylinder and a second cylinder.

A positioning reference hole 18 is formed upwards from an under surface of the right lateral wall 6 of the crank case 1. When working the cylinder block 19, a positioning pin is fitted into the reference hole 18, thereby enabling the cylinder block 19 to position on a surface predetermined to place the cylinder block 19 thereon. The reference hole 18 communicated with the right oil passage 8 is sealed by a steel ball 20 struck thereinto after the cylinder block 19 has been worked. Further, in the case where the reference hole 18 is formed in the left lateral wall 15 to communicate with the left oil passage 7, the reference hole 18 is similarly sealed by the steel ball 20.

The bearing of the crank shaft has the following structure.

As shown in FIG. 1, the crank case 1 has an interior area partitioned by partition walls 14 and 15 for every cylinder. These partition walls 14 and 15 are formed with intermediate bearing holes 14*a* and 15*a* which support intermediate journal portions 14*c* and 15*c* of the crank shaft 4 through bearing cases 14*b* and 15*b*. The crank case 1 has an end wall 16 opened to form a bearing hole 16*a* which supports an end journal portion 16*c* of the crank shaft 4 through a bearing case 16*b*. Internally fitted into the bearing cases 14*b*, 15*b* and 16*b* are bearing metals which contact with the respective journal portions 14*c*, 15*c* and 16*c*.

The crank shaft is accommodated into the crank case in the following manner.

Figure 4:
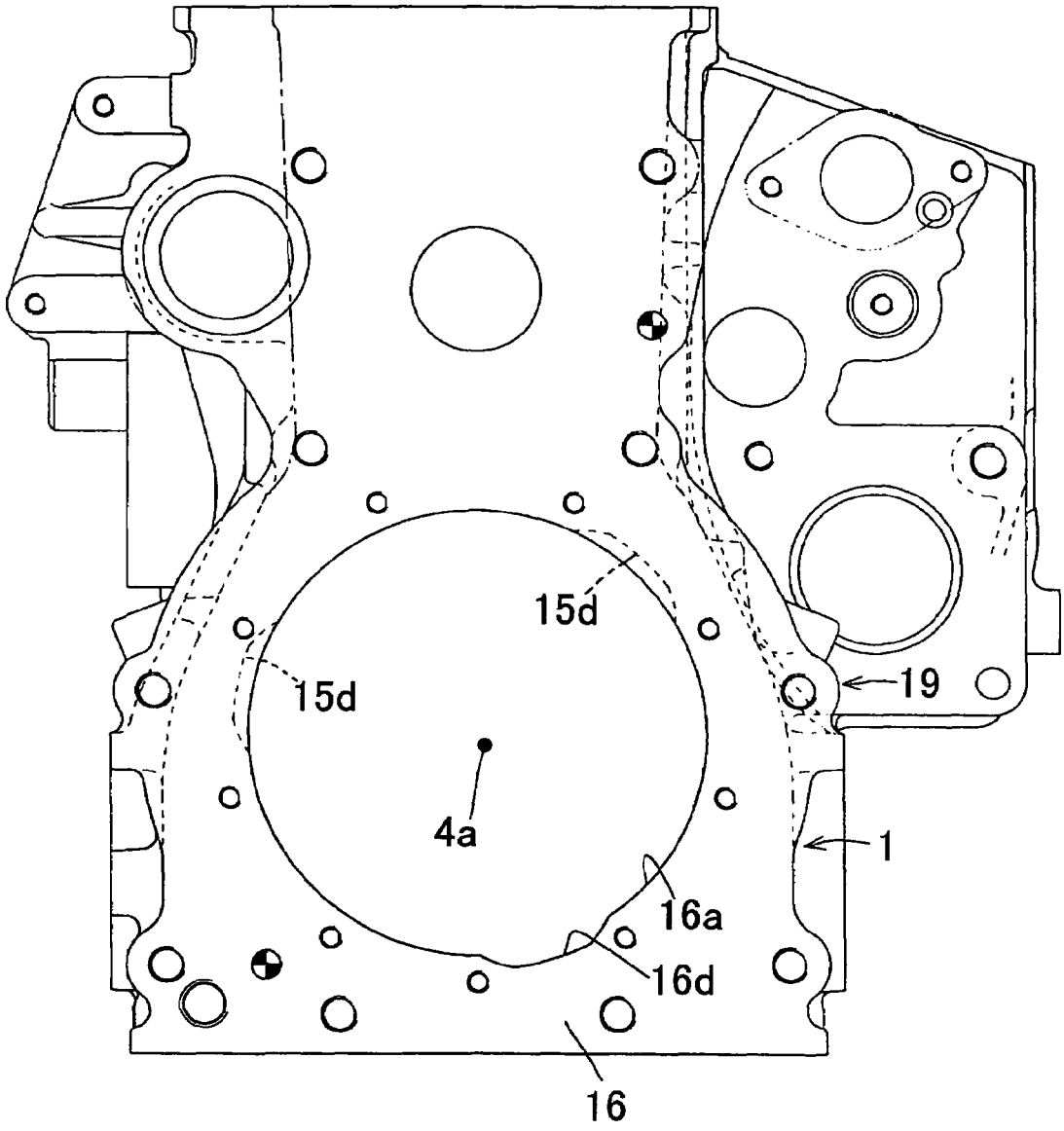
FIG. 4 is a rear view of the cylinder block of the engine shown in FIG. 1.
Figure 5:
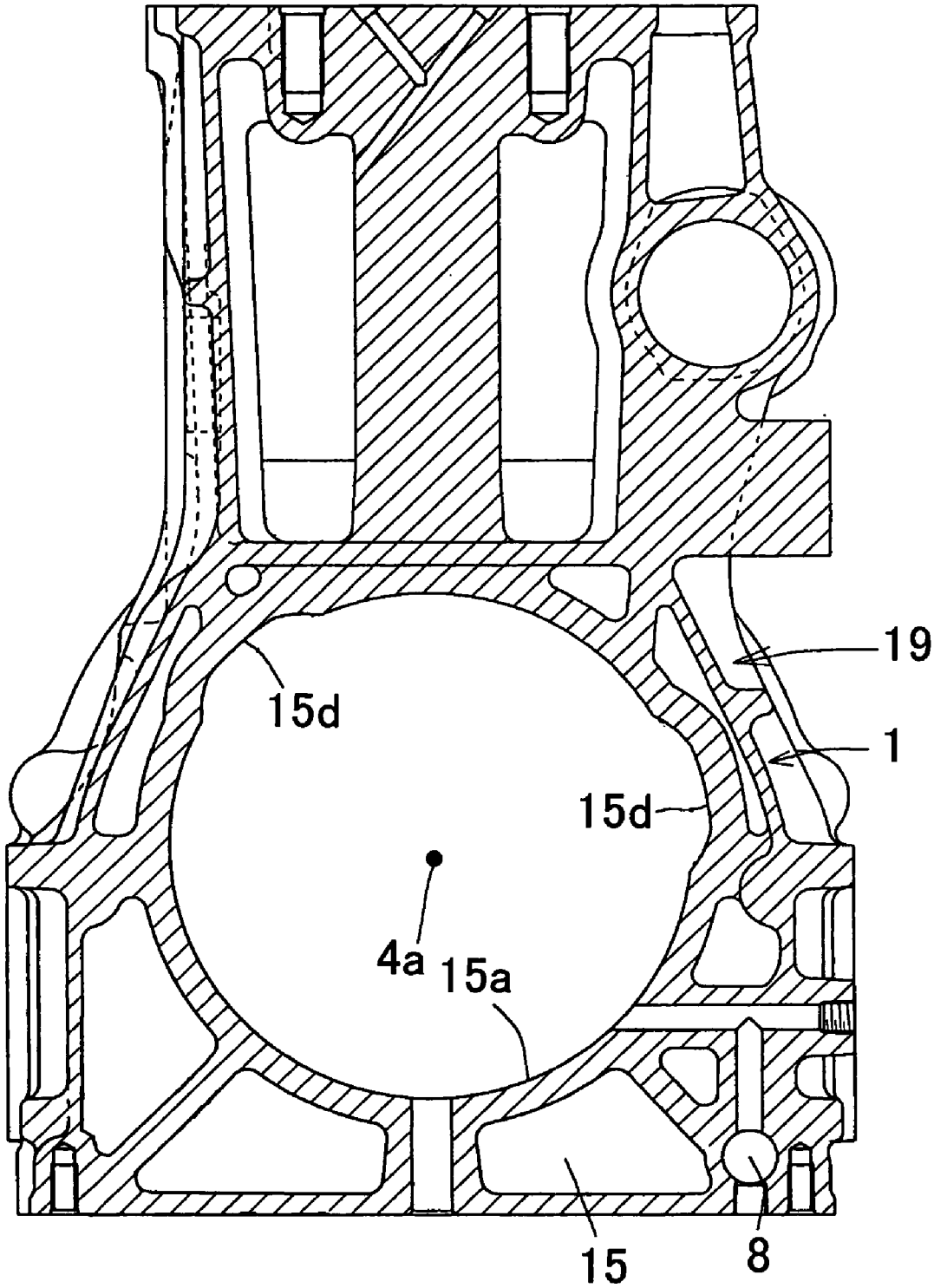
FIG. 5 is a sectional view taken along a line V-V in FIG. 3.

With the crank shaft 4 having the intermediate journal portions 14*c* and 15*c* and the end journal portion 16*c* attached to the respective bearing cases 14*b*, 15*b* and 16*b*, the crank shaft 4 is inserted through the end bearing hole 16*a* and then through the intermediate holes 15*a* and 14*a* to accommodate the crank shaft 4 into the crank case 1. As such, in order to accommodate the crank shaft 4 within the crank case 1, as shown in FIGS. 2, 4 and 5, a rotation radius from a center axis 4*a* of the crank shaft 4 to the outermost portion of a crank pin 17 is made larger than an inner diameter of each of the intermediate bearing holes 14*a* and 15*a*, and the end bearing hole 16*a*. Further, the intermediate bearing holes 14*a* and 15*a*, and the end bearing hole 16*a* have peripheral edge portions provided with recesses 14*d*, 15*d* and 16*d*, thereby allowing the outermost portion of the crank pin 17 to pass through the recesses 14*d*, 15*d* and 16*d* when accommodating the crank shaft 4 into the crank case 1.

As shown in FIG. 4, the crank case 1 has the end wall 16 provided with one recess 16*d*. This recess 16*d* is arranged at a lower side portion of the end bearing hole 16*a*. As shown in FIG. 2, a partition wall 14 between the first cylinder and the second cylinder of the crank case is provided with two recesses 14*d* and 14*d*. As illustrated in FIG. 5, a partition wall 15 between the second cylinder and the third cylinder is also provided with two recesses 15*d* and 15*d*. As shown in FIG. 4, the recesses 15*d* and 15*d* of the partition wall 15 between the second cylinder and the third cylinder are arranged with a phase difference of 120 degrees in a clockwise direction and a counter-clockwise direction with respect to the recess 16*d* of the end wall 16 when seen in a direction parallel to the center axis 4*a* of the crank shaft 4. Each of the recesses 15*d* and 15*d* is arranged at a upper side portion of the intermediate bearing hole 15*a*. As shown in FIG. 2, the two recesses 14*d* and 14*d* provided in the partition wall 14 between the first cylinder and the second cylinder are disposed to overlap the recesses 15*d* and 15*d* of the partition wall 15 when seen in the direction parallel to the center axis 4*a* of the crank shaft 4. Therefore, these two recesses 14*d* and 14*d* are also arranged at the upper side portion of the intermediate bearing hole 14*a*. The phase difference between the recesses 14*d*, 15*d* and 16*d* is consistent with a phase difference between the respective crank pins 17 of the crank shaft 4.

The timing gear case and the oil pan have the following relationship.

As shown in FIG. 1, in order to attach the timing gear case 21 at one end portion of the crank case 1 and the oil pan 3 at a lower portion of the crank case 1, the timing gear case 21 has a lower end 21*a* extended down to a lower end 1*a* of the crank case 1 and the oil pan 3 is extended up to below this timing gear case 21. The extended portion 3*a* of the oil pan 3 has an upper end attached to the lower end 21*a* of the timing gear case 21. The extended portion 3*a* of the oil pan 3 is attached to the timing gear case 21 by an oil-pan attaching bolt 43 in the same manner as the other portions are attached to the crank case 1. The oil pan 3 is formed from a sheet metal and is made attachable to the crank case 1 even if it is reversed in the front and rear direction. The oil pan 3 has a bottom wall provided with an oil drain 44 close to one end in the front and rear direction and made to be able to be arranged at the alternative of the front side portion and the rear side portion in accordance with the reversion in the front and rear direction of the oil pan 3.

A structure for attaching the auxiliary machine is as follows.

Figure 7:
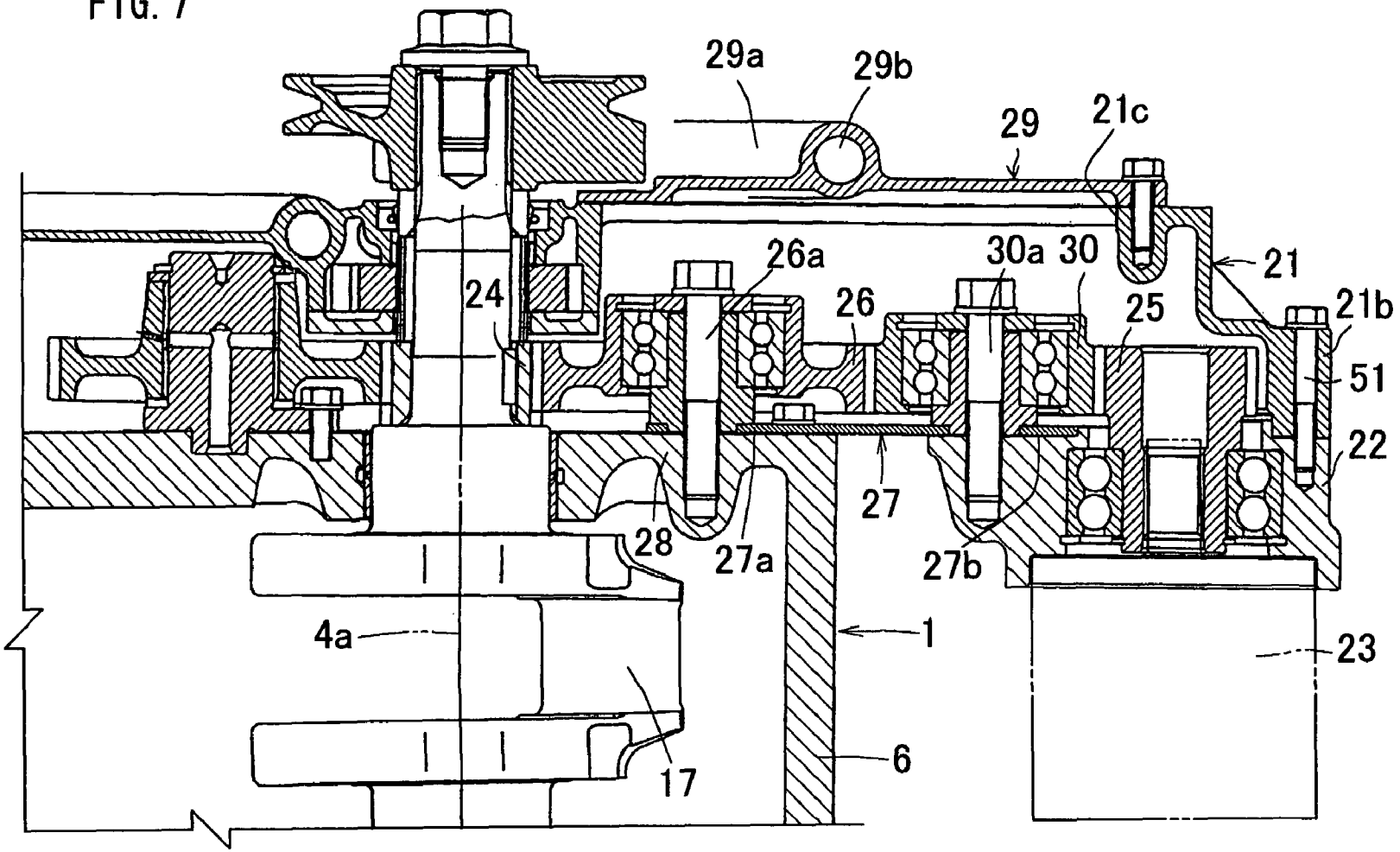
FIG. 7 is a bottom view, in cross section of the gear case and its surroundings of the engine shown in FIG. 1.

As shown in FIG. 6(A), when seen in the direction parallel to the center axis 4*a* of the crank shaft 4, the timing gear case 21 has a lower portion projected laterally from the lateral wall 6. The thus laterally projected portion 21*b* of the timing gear case 21 is provided with a seat 22 for attaching the auxiliary machine 23. As illustrated in FIG. 7, the seat 22 for attaching the auxiliary machine 23 is provided at a rear portion of the laterally projected portion 21*b* of the timing gear case 21. The auxiliary machine 23 attached to the seat 22 is arranged to position along the lateral wall 6 of the crank case 1. As shown in FIG. 8(A), the auxiliary machine 23 is attached to the seat 22 for attaching the same by attaching bolts inserted through a pair of upper and lower holes 49, 49 for attaching the auxiliary machine 23.

A structure for attaching a first idling gear is as follows.

As shown in FIG. 7, a first idling gear 26 is arranged between a crank gear 24 and an input gear 25 for the auxiliary machine 23. The timing gear case 21 has a rear wall 27 composed of an overlapping portion 27*a*, where the rear wall 27 overlaps the front wall 28 of the crank case 1, and a portion 27*b* projecting laterally from the front wall 28 of the crank case 1. The overlapping portion 27*a* is fixed in pressure-contact with the front wall 28 of the crank case 1 through a fastening force of an idling-gear attaching bolt 26*a*.

A structure for inserting the first idling gear into the timing gear case is as follows.

Figure 6:
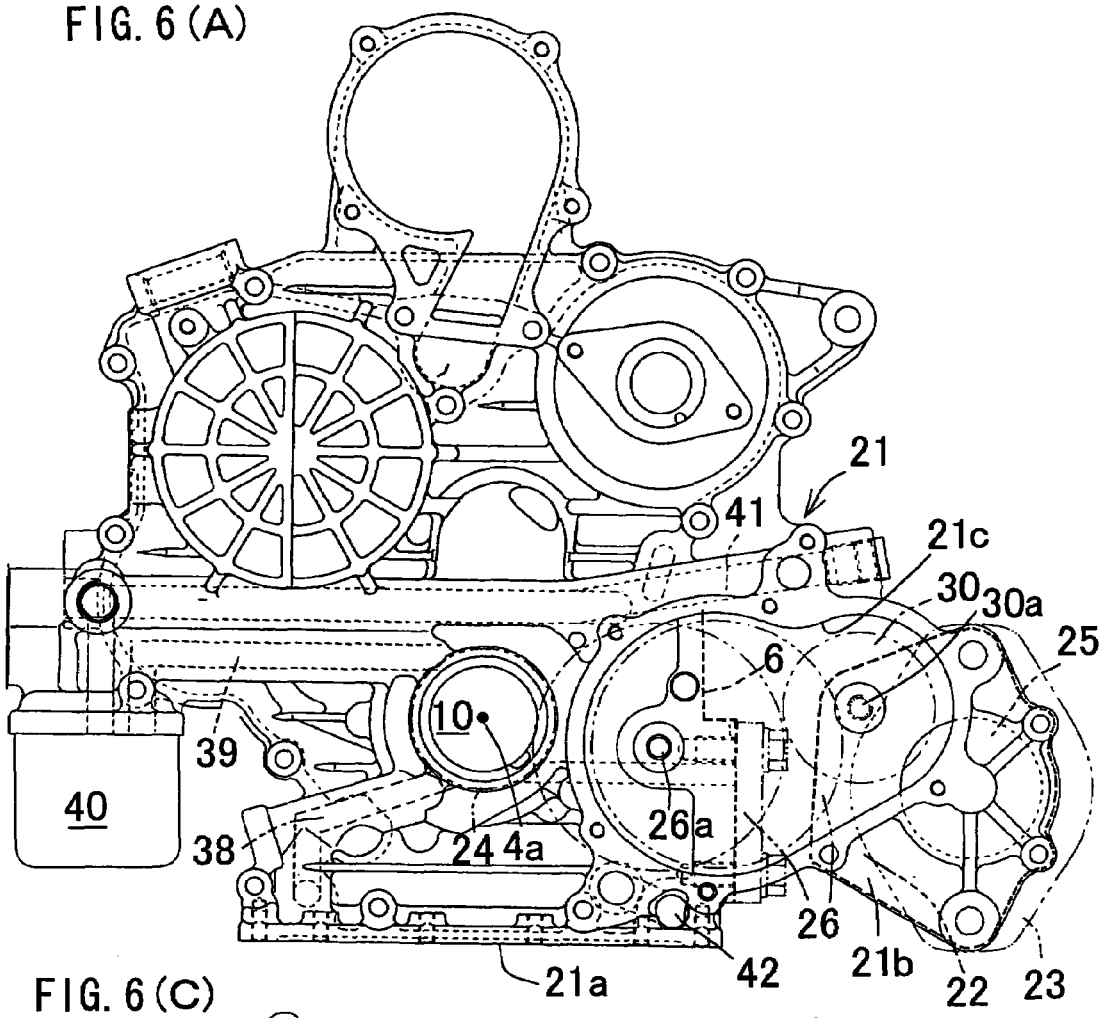
FIG. 6 is an explanatory view of a gear case of the engine shown in FIG. 1.
Figure 6:
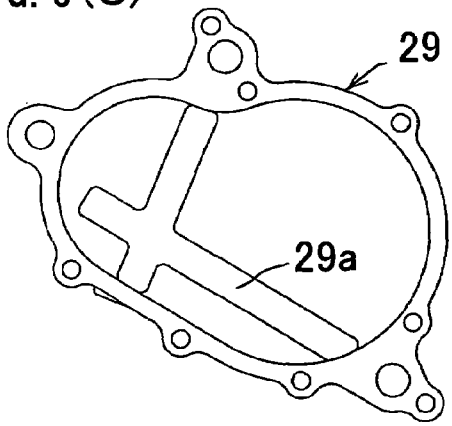
Figure 6B:
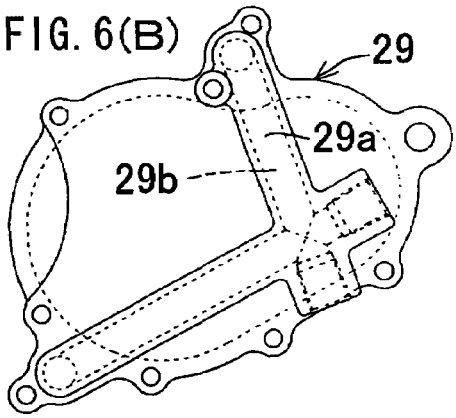
Figure 9:
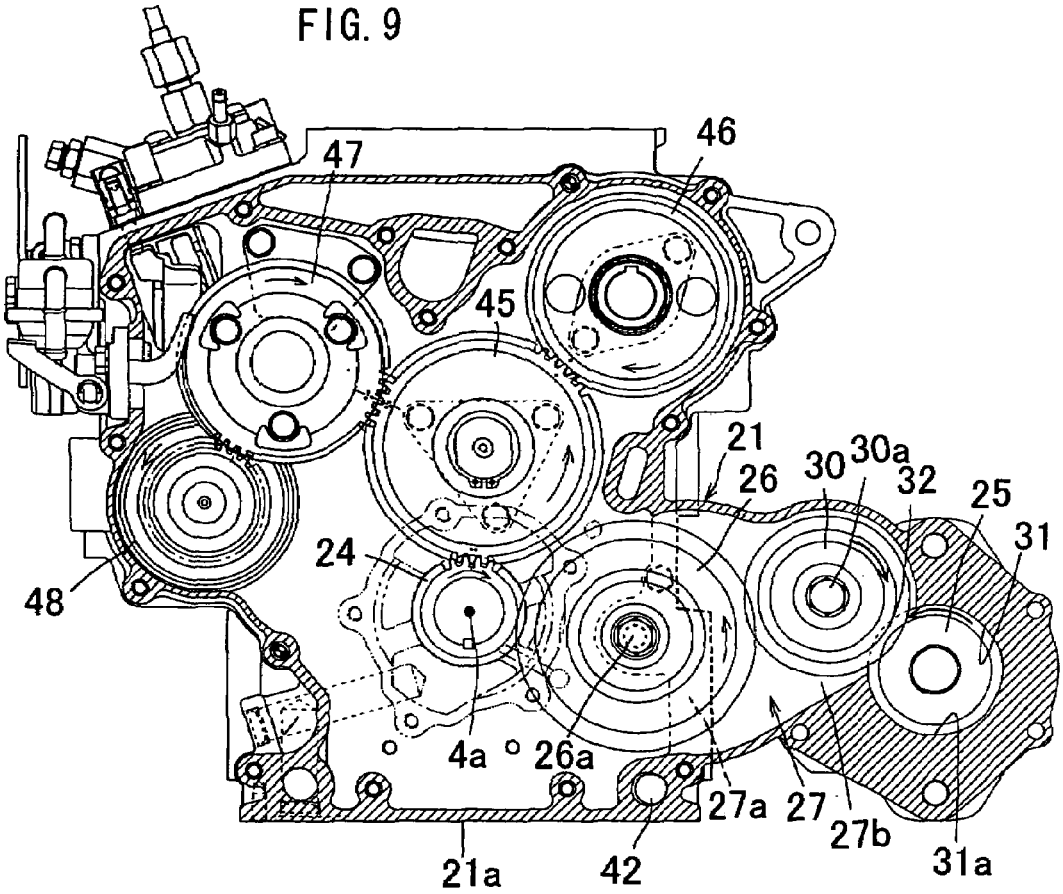
FIG. 9 is a vertical and sectional front view of the gear case of the engine shown in FIG. 1.

As shown in FIG. 6(A), the timing gear case 21 has a front surface provided with an opening portion 21*c*, through which the first idling gear 26 can be inserted into the timing gear case 21. In order to do so, as shown in FIGS. 6(B) and 6(C), a closure 29 for the opening portion 21*c* is formed with a rib 29*a*, which is internally provided with an oil passage 29*b*. This oil passage 29*b* relays an oil-purification passage 41, which traverses the timing gear case 21 in the left and right direction at a position higher than the oil pump 10, with an oil-purification outlet 42 disposed at a position lower than the oil pump 10. The left and right oil passages 7 and 8 communicate with each other through this oil passage 29*b* within the rib 29*a*. Further, in FIG. 6(A), the first idling gear 26 is inserted into the timing gear case 21 from the opening portion 21*c* in a state indicated by a right two-dot chain line and is moved to a state designated by a left two-dot chain line. Then as shown in FIG. 9, it meshes with the crank gear 24 at the rear portion of the oil pump 10. Further, as shown in FIGS. 6(B) and 6(C), the rib 29*a* of the closure 29 is formed so that it is bent along a surface of the closure 29.

A structure for attaching the auxiliary machine is as follows.

As shown in FIG. 7, a second idling gear 30 is provided between the first idling gear 26 and the input gear 25 for the auxiliary machine 23. The seat 22 for attaching the auxiliary machine 23 is arranged to position along the laterally projected portion 27*b* of the rear wall 27 of the timing gear case 21 and is fixed thereto through a fastening force of an attaching bolt 30*a* of the second idling gear 30. This second idling gear 30 is also inserted into the timing gear case 21 from the opening portion 21*c*. As shown in FIG. 8, the seat 22 for attaching the auxiliary machine 23 is fixed to the laterally projected portion 27*b* through a fastening force of the attaching bolt 30*a* of the second idling gear 30 and of attaching bolts 51 inserted through three holes 50 for attaching the seat 22.

A structure for supplying the oil to a portion where the gears mesh with each other.

As shown in FIG. 9, when seen in the direction parallel to the center axis 4*a* of the crank shaft 4, if an observation is made when the second idling gear 30 is meshed with the input gear 25 for the auxiliary machine 23 from a left upper portion of the latter, the second idling gear 30 is made to rotate in the clockwise direction and the input gear 25 for the auxiliary machine 23 is made to rotate in the counter-clockwise direction. The oil which stays at a bottom 31*a* of a gear accommodating chamber 31 which accommodates the input gear 25 for the auxiliary machine 23 is lifted up along an inner peripheral surface of the gear accommodating chamber 31 by the rotation of the input gear 25 for the auxiliary machine 23 and is supplied to a portion 32 where the second idling gear 30 meshes with the input gear 25 for the auxiliary machine 23.

The auxiliary machine has the following function.

The auxiliary machine 23 is a hydraulic pump. This hydraulic pump is arranged to exert output to the external load applied to the engine. This hydraulic pump is a so-called oil pump for extracting full load, which exerts full output to the external load applied to the engine.

A structure of a gear train within the timing gear case is as follows.

As shown in FIG. 9, when seen in the direction parallel to the center axis 4*a* of the crank shaft 4 from a front surface, the first idling gear 26 is meshed with the crank gear 24 from a right side of the latter and the second idling gear 30 is meshed with the first idling gear 26 from a right side of the latter. The input gear 25 for the auxiliary machine 23 is meshed with the second idling gear 30 from a right lower portion of the latter. A third idling gear 45 is meshed with the crank gear 24 from an upper portion of the latter. A valve operating cam gear 46 is meshed with the third idling gear 45 from a right upper portion of the latter. A fuel injection cam gear 47 is meshed with the third idling cam gear 45 from a left upper portion of the latter. A governor gear 48 is meshed with the fuel injection cam gear 47 from a left lower portion of the latter.

What is claimed is:

1. An engine comprising:

a crank case (1) provided with a lower opening portion (2), the crank case being covered from below with an oil pan (3); and a crank shaft (4) positioned within the crank case and extending in front and rear directions, the crank case being provided with a pair of left and right oil passages (7) and (8) which respectively extend in the front and rear directions along left and right lateral walls (5) and (6) of the crank case (1);

wherein the left and right lateral walls (5) and (6) of the crank case (1) are provided with left and right ribs (12) and (13) which respectively extend in the front and rear directions, the left and right ribs being raised inwardly from the left and right lateral walls (5) and (6) of the crank case (1), the left and right ribs (12) and (13) being positioned at the lower opening portion (2) at a lower end of the crank case (1) and include therein, the left and right oil passages (7) and (8).

2. The engine as set forth in claim 1, wherein the crank case (1) has an interior area partitioned by partition walls (14) and (15);

a plurality of cylinders are defined by the partitioned walls (14) and (15), the partition walls (14) and (15) including openings which form intermediate bearing holes (14*a*) and (15*a*), the intermediate bearing holes (14*a*) and (15*a*) supporting intermediate journal portions (14*c*) and (15*c*) of the crank shaft (4) through bearing cases (14*b*) and (15*b*);

the crank case (1) has an end wall (16) opened to form an end bearing hole (16*a*) which supports an end journal portion (16*c*) of the crank shaft (4) through a bearing case (16*b*); and a rotation radius from a center axis (4*a*) of the crank shaft (4) to the outermost portion of a crank pin (17) being larger than an inner diameter of each of the intermediate bearing holes (14*a*) and (15*a*) and the end bearing hole (16*a*) in order to accommodate the crank shaft (4) within the crank case (1) with the respective bearing cases (14*b*), (15*b*) and (16*b*) attached to the intermediate journal portions (14*c*) and (15*c*) and the end journal portion (16*c*) of the crank shaft (4), after the crank shaft (4) has been inserted through the end bearing hole (16*a*) and then through the intermediate bearing holes (15*a*) and (14*a*), the intermediate bearing holes (14*a*) and (15*a*) and the end bearing hole (16*a*) having peripheral edge portions provided with recesses (14*d*), (15*d*) and (16*d*), thereby enabling the outermost portion of the crank pin (17) to pass through the recesses (14*d*), (15*d*) and (16*d*) on accommodating the crank shaft (4) within the crank case (4).

3. The engine as set forth in claim 2, wherein the recesses (14*d*) and (15*d*) of the intermediate bearing holes (14*a*) and (15*a*) are arranged at an upper side portion of the intermediate bearing holes (14*a*) and (15*a*).

4. The engine as set forth in claim 1, wherein the right lateral wall 6) is opened to form a positioning reference hole (18) upwards of an under surface of the right lateral wall 6) and the reference hole (18) in communication with either of the left and right oil passages (7) and (8) is sealed by a steel ball (20) struck thereinto after a cylinder block (19) has been worked in order to fit a positioning pin into the reference hole (18) when working the cylinder block (19), thereby enabling the cylinder block (19) to be positioned on a predetermined surface to place the cylinder block (19) thereon.

5. The engine as set forth in claim 1, wherein a timing gear case (21) has a lower end (21*a*) that extends down to a height of a lower end (1*a*) of the crank case (1) in order to attach the timing gear case (21) to one end of the crank case (1), the oil pan (3) has an extended portion (3*a*) that extends below the timing gear case (21), the extended portion (3*a*) of the oil pan (3) having an upper end attached to the lower end (21*a*) of the timing gear case (21) in order to attach the oil pan (3) to a lower portion of the crank case (1).

6. The engine as set forth in claim 5, wherein when seen in a direction parallel to a center axis (4*a*) of the crank shaft (4), the timing gear case (21) has a lower portion (21*b*) projected further laterally than the lateral wall (6) of the crank case (1), the laterally projected portion (21*b*) of the timing gear case (21) being provided with a seat (22) for attaching an auxiliary machine.

7. The engine as set forth in claim 6, wherein a seat (22) for attaching an auxiliary machine is provided at a rear portion of the laterally projected portion (21*b*) of the timing gear case (21) and the auxiliary machine (23) attached to the seat (22) is positioned along the right lateral wall (6) of the crank case (1).

8. The engine as set forth in claim 6, wherein a first idling gear (26) is arranged between a crank gear (24) and an input gear (25) for the auxiliary machine (23), a rear wall (27) of the timing gear case (21) is composed of an overlapping portion (27*a*), which overlaps a front wall (28) of the crank case (1), and a portion (27*b*) projecting laterally of the front wall (28) of the crank case (1), and the overlapping portion (27*a*) is fixed in pressure-contact with the front wall (28) of the crank case (1) by a bolt (26*a*) for attaching the first idling gear (26).

9. The engine as set forth in claim 8, wherein the timing gear case (21) has a front surface opened to provide an opening portion (21*c*), a cover (29) for the opening portion (21*c*) is formed with a rib (29*a*) which is internally provided with an oil passage (29*b*), the left and right oil passages (7) and (8) being in fluid communication with each other through the oil passage (29*b*) within the rib (29*a*) in order to allow the first idling gear (26) to be inserted from opening portion (21*c*) into the timing gear case (21).

10. The engine as set forth in claim 9, wherein the rib (29*a*) of the closure (29) is formed so that the rib is bent along a surface of the closure (29).

11. The engine as set forth in claim 8, wherein a second idling gear (30) is provided between the first idling gear (26) and the input gear (25) for the auxiliary machine (23), the seat (22) for attaching the auxiliary machine (23) is positioned along the laterally projected portion (27*b*) of the rear wall (27) of the timing gear case (21) and is fixed to the laterally projected portion (27*b*) by an attaching bolt (30*a*) for the second idling gear (30).

12. The engine as set forth in claim 11, wherein when seen in the direction parallel to the center axis (4*a*) of the crank shaft (4) in a state where the second idling gear (30) is meshed with the input gear (25) for the auxiliary machine (23) from a left portion of the auxiliary machine (23), the second idling gear (30) is arranged to be rotated in a clockwise direction, the input gear (25) for the auxiliary machine (23) is made to rotate in a counter-clockwise direction, and oil which stays at a bottom (31*a*) of a gear accommodating chamber (31) which accommodates the input gear (25) for the auxiliary machine (23) is lifted up along an inner peripheral surface of the gear accommodating chamber (31) by the rotation of the input gear (25) for the auxiliary machine (23) and is supplied to a portion (32) where the second idling gear (30) meshes with the input gear (25) for the auxiliary machine (23) from above.

13. The engine as set forth in claim 6, wherein the auxiliary machine (23) is a hydraulic pump which exerts output to an external load applied to the engine.

* * * * *